US010371403B2

(12) United States Patent
Fujihira et al.

(10) Patent No.: US 10,371,403 B2
(45) Date of Patent: Aug. 6, 2019

(54) DISPLAY DEVICE, METHOD, AND PROGRAM

(71) Applicant: Johnson Controls-Hitachi Air Conditioning Technology (Hong Kong) Limited, Hong Kong (CN)

(72) Inventors: Toru Fujihira, Tokyo (JP); Emi Saito, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 287 days.

(21) Appl. No.: 15/314,540

(22) PCT Filed: Jun. 20, 2014

(86) PCT No.: PCT/JP2014/066454
§ 371 (c)(1),
(2) Date: Nov. 29, 2016

(87) PCT Pub. No.: WO2015/194041
PCT Pub. Date: Dec. 23, 2015

(65) Prior Publication Data

US 2017/0191689 A1 Jul. 6, 2017

(51) Int. Cl.
*G05D 23/00* (2006.01)
*F24F 11/32* (2018.01)
(Continued)

(52) U.S. Cl.
CPC ..... *F24F 11/32* (2018.01); *F24F 11/30* (2018.01); *F24F 11/62* (2018.01); *F24F 11/89* (2018.01);
(Continued)

(58) Field of Classification Search
CPC . F24F 3/001; F24F 11/30; F24F 11/32; G05D 23/19; F16P 7/02; H04M 1/72513;
(Continued)

(56) References Cited

U.S. PATENT DOCUMENTS 4,307,775 A * 12/1981 Saunders ..... F16P 7/02 165/11.1
4,857,918 A * 8/1989 Nukushina ..... G05D 23/19 340/870.01
(Continued)

FOREIGN PATENT DOCUMENTS

JP 10-267327 A 10/1998
JP 2004-176973 A 6/2004
(Continued)

OTHER PUBLICATIONS

Chinese Office Action received in corresponding Chinese Application No. 201480080035.9 dated Sep. 30, 2018.
(Continued)

*Primary Examiner* — Tuan A Vu
(74) *Attorney, Agent, or Firm* — Mattingly & Malur, PC

(57) ABSTRACT

A display device which displays operation information of an air conditioner in which an outdoor machine including an outdoor heat exchanger and an indoor machine including an indoor heat exchanger are connected. The display device includes a control unit that determines whether or not abnormality occurs in the outdoor machine or the indoor machine when the air conditioner operates, and a display unit which is controlled by the control unit so as to display time information and to display a plurality of operation information display regions for displaying operation information corresponding to the time information, in line. In a case where the control unit determines that the abnormality has occurred in the outdoor machine or the indoor machine, the control unit controls the display unit to display operation information of the outdoor machine or the indoor machine in which the abnormality has occurred, in the operation information display region.

14 Claims, 8 Drawing Sheets

(51) Int. Cl.

| | |
|---|---|
| ***F24F 11/89*** | (2018.01) |
| ***F24F 11/62*** | (2018.01) |
| ***F24F 11/30*** | (2018.01) |
| ***F25B 49/00*** | (2006.01) |
| *F24F 11/52* | (2018.01) |

(52) U.S. Cl.
CPC ..... *F25B 49/005* (2013.01); *F24F 11/52* (2018.01); *F25B 2500/22* (2013.01); *Y10S 165/002* (2013.01)

(58) Field of Classification Search
CPC . G05B 19/042; F25B 2500/22; Y10S 165/002
See application file for complete search history.

(56) References Cited

U.S. PATENT DOCUMENTS

2004/0210419 A1 10/2004 Wiebe et al.
2007/0032225 A1* 2/2007 Konicek ..... H04M 1/72513 455/417
2007/0056298 A1 3/2007 Baker et al.
2010/0065245 A1* 3/2010 Imada ..... F24F 3/001 165/59
2010/0070907 A1* 3/2010 Harrod ..... G05B 19/042 715/772
2011/0130880 A1* 6/2011 Nishino ..... F24F 11/30 700/276
2011/0130887 A1 6/2011 Ehlers, Sr.
2012/0101778 A1 4/2012 Gyota et al.
2015/0204561 A1* 7/2015 Sadwick ..... G05D 23/1905 236/1 C
2015/0369502 A1* 12/2015 Turner ..... F24F 11/30 700/276

FOREIGN PATENT DOCUMENTS

JP 2008-309379 A 12/2008
JP 2013-024546 A 2/2013

OTHER PUBLICATIONS

International Search Report of PCT/JP2014/066454 dated Sep. 2, 2014.
Japanese Office Action received in corresponding Japanese Application No. 2016-528757 dated Jan. 9, 2018.
Chinese Office Action received in corresponding Chinese Application No. 201480080035.9 dated Jan. 16, 2019.

* cited by examiner

FIG. 7

700

| ID | REFRIGERANT SYSTEM | ADDRESS | TYPE | ・・・ |
|---|---|---|---|---|
| 1 | 1 | 1 | OUTDOOR MACHINE | |
| 2 | 1 | 2 | INDOOR MACHINE | |
| 3 | 1 | 3 | INDOOR MACHINE | |
| 4 | 2 | 1 | OUTDOOR MACHINE | |
| 5 | 2 | 2 | INDOOR MACHINE | |
| 6 | 3 | 1 | OUTDOOR MACHINE | |
| ・<br>・<br>・ | | | | |

FIG. 8

800

| ID3 : INDOOR MACHINE 2 | | | | |
|---|---|---|---|---|
| TIME POINT | ALARM CODE | SUCTION TEMPERATURE | BLOWING TEMPERATURE | ・・・ |
| 10:00:00 | – | 30 | 16 | |
| 10:00:20 | – | 30 | 16 | |
| 10:00:40 | – | 29 | 17 | |
| 10:01:00 | – | 29 | 18 | |
| 10:01:20 | – | 28 | 18 | |
| 10:01:40 | 101 | – | – | |
| ・<br>・<br>・ | | | | |

DISPLAY DEVICE, METHOD, AND PROGRAM

TECHNICAL FIELD

The present invention relates to a display device, a method, and a program which are used in a test drive of an air conditioner.

BACKGROUND ART

As the background art of this technical field, there is JP-A-2013-24546 (PTL 1). In PTL 1, it is disclosed as an object "that an object is to obtain an air conditioner management system which can realize management of an air conditioner with low cast, and does not have an influence in security on a management system which refers to an air conditioning system of centrally managing a plurality of air conditioners". In addition, in PTL 1, it is disclosed as means for solving the problem, "that an air conditioner management system according to this invention includes first communication means for communicating between one or a plurality of air-conditioning units which are configured by at least one indoor machine and one outdoor machine, and a centralized controller, and for transmitting information of the air-conditioning unit to the centralized controller; second communication means for performing communication between the centralized controller and communication equipment, and for transmitting the information of the air-conditioning unit transmitted to the centralized controller, to the communication equipment; and third communication means for transmitting the information transmitted to communication equipment, to an individual information management server that manages pieces of information of the air-conditioning units".

CITATION LIST

Patent Literature

PTL 1: JP-A-2013-24546

SUMMARY OF INVENTION

Technical Problem

The constructed air conditioner is required to confirm an operation by performing a test drive. In PTL 1, connection information and identification information of an air conditioner may be obtained by using a portable terminal such as a smart phone, during a test drive. However, means for confirming operation information required for determining a test drive state, on a portable terminal is not disclosed in PTL 1.

In particular, in a case where any abnormality occurs during the test drive, confirming operation information relating to an abnormality occurrence place, on the portable terminal is difficult.

Thus, the present invention is to provide a display device, a method, and a program in which operation information required for determining a test drive state, particularly, operation information relating to an abnormality occurrence place when abnormality has occurred can be comprehensibly and immediately confirmed on a portable terminal.

Solution to Problem

This application includes plural pieces of means for solving the above-described problems. As an example, a display device which displays operation information of an air conditioner in which an outdoor machine including an outdoor heat exchanger and an indoor machine including an indoor heat exchanger are connected to each other by a refrigerant pipe, and a refrigerant is circulated by a compressor is provided. The display device includes a control unit that determines whether or not abnormality has occurred in the outdoor machine or the indoor machine when the air conditioner operates. The display device includes a display unit that displays information. The control unit controls the display unit to display time information and to display a plurality of operation information display regions for displaying operation information corresponding to the time information, in line. In a case where the control unit determines that the abnormality has occurred in the outdoor machine or the indoor machine, the control unit controls the display unit to display operation information of the outdoor machine or the indoor machine in an operation information display region.

An example of another aspect according to the present invention is a display method which is performed in an information terminal including an input device, a display device, a processing device, and a storage device. The display method is a method for displaying operation information of an air conditioner in which an outdoor machine including an outdoor heat exchanger and an indoor machine including an indoor heat exchanger are connected to each other by a refrigerant pipe, and a refrigerant is circulated by a compressor. The method includes an acquisition step for causing the input device to acquire operation information of the air conditioner, and a storing step for causing the storage device to store the acquired operation information. Further, the method includes an abnormality determination step for causing the processing device to determine whether or not abnormality has occurred in the outdoor machine or the indoor machine when the air conditioner operates. In addition, the method includes a display step for causing the display device to display time information and to display at least a first operation information display region and a second operation information display region for displaying operation information corresponding to the time information, in line. In a case where it is determined, in the abnormality determination step, that the abnormality has occurred in the outdoor machine or the indoor machine, in the display step, operation information of the outdoor machine or the indoor machine in which the abnormality has occurred, is displayed in the first or second operation information display region.

An example of another aspect according to the present invention is a program which is operated in an information terminal including an input device, a display device, a processing device, and a storage device. The program is executed for causing the display device to display operation information of an air conditioner in which an outdoor machine including an outdoor heat exchanger and an indoor machine including an indoor heat exchanger are connected to each other by a refrigerant pipe, and a refrigerant is circulated by a compressor. The program executes a determination process of determining whether or not abnormality has occurred in the outdoor machine or the indoor machine when the air conditioner operates, based on information which is input from the input device. When the operation information input from the input device is displayed, the display device is controlled to display time information in the display unit in a transverse direction, and to display a plurality of operation information display regions for displaying operation information corresponding to the time information, in a vertical direction or the transverse direction, in a line. In a case where it is determined in the determination process, that the abnormality has occurred in the outdoor machine or the indoor machine, operation information of the outdoor machine or the indoor machine in which the abnormality has occurred, is displayed in one of the operation information display regions. In addition, operation information of an indoor machine or an outdoor machine which is connected to the outdoor machine or the indoor machine in which the abnormality has occurred, by a refrigerant pipe is displayed in another of the operation information display regions.

Advantageous Effects of Invention

According to the present invention, it is possible to immediately and comprehensibly confirm operation information required for determining an operation state of an air conditioner, particularly operation information relating to an abnormality occurrence place in a case where abnormality has occurred, on a portable terminal.

An object, a configuration, and an advantage other than the above descriptions are apparent by descriptions of the following embodiments.

BRIEF DESCRIPTION OF DRAWINGS

FIG. 7 is a table illustrating an example of connection information of an air conditioner.

FIG. 8 is a table illustrating an example of operation information stored in a storage unit 206.

DESCRIPTION OF EMBODIMENTS

Figure 1:
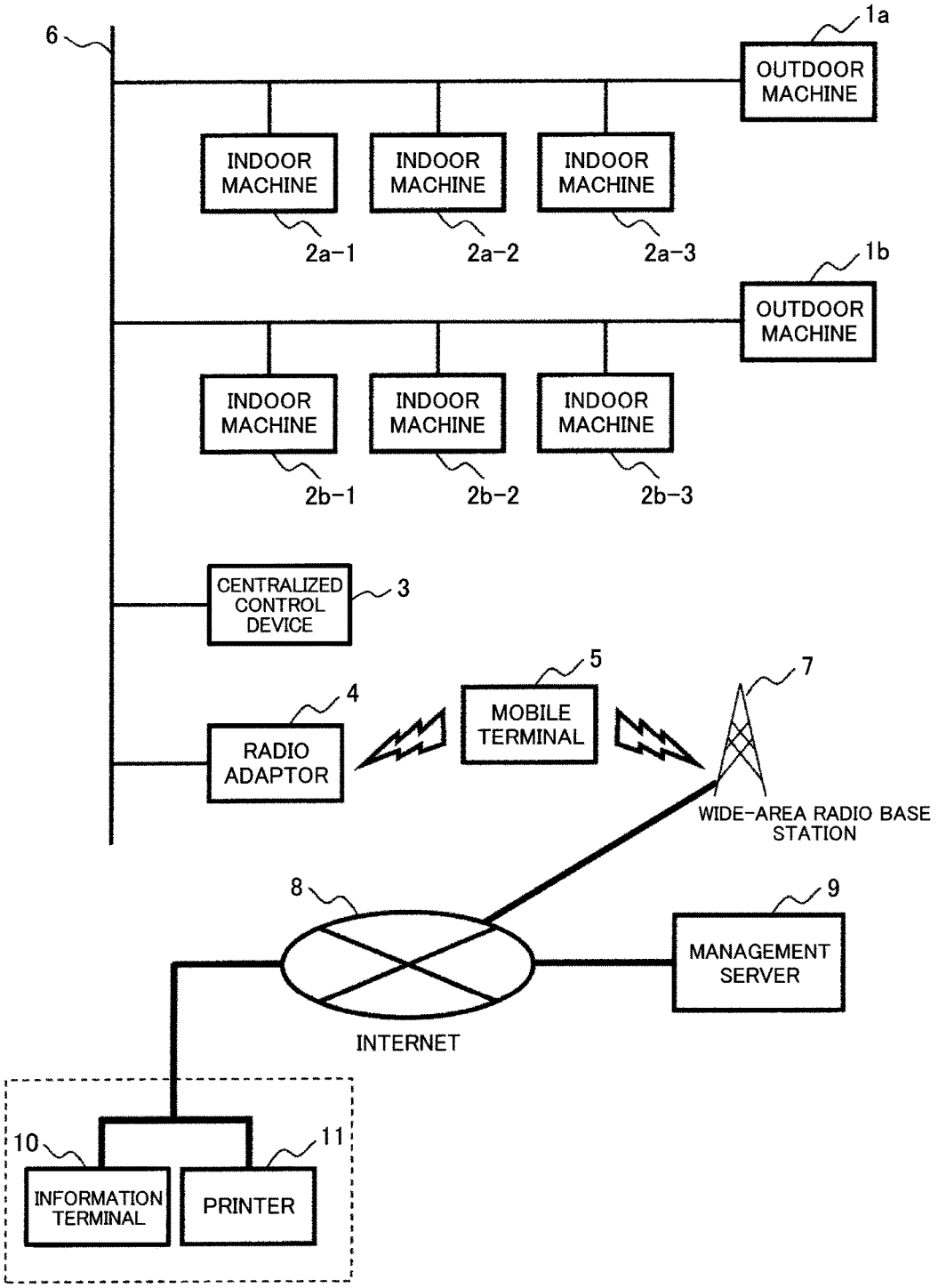
FIG. 1 is a configuration diagram illustrating the entirety of an air-conditioner test drive system in a case where the present invention is applied to a mobile terminal.

Hereinafter, examples of the present invention will be described with reference to the drawings. However, the present invention is not interpreted as being limited to details described in the following embodiments. If being a person skilled in the related art, it is easily understood that the specific configuration may be changed in a range without departing from the idea and the gist of the present invention.

In a configuration of the invention which will be described below, the same reference signs are commonly used for the same parts or parts having similar functions, in the different drawings. The repetitive descriptions will be omitted. In a case where a plurality of parts having the similar functions is provided, for distinguishment, alphabets such as a and b, hyphens, and numerical characters may be appended to the same reference signs. In a case where distinguishment is not required, the reference signs may be described with omitting a, b, and the like.

In this specification and the like, notations of "the first", "the second", "the third", and the like are appended in order to distinguish components from each other, and it is not necessarily limited to the number of components or an order thereof.

For easy understandings of the invention, the position, the size, the shape, the range, and the like of each component illustrated in the drawings and the like may not indicate a practical position, a practical size, a practical shape, a practical range, and the like. Thus, the present invention is not necessarily limited to the positions, the sizes, the shapes, the ranges, and the like illustrated in the drawings and the like.

Publications, Patents, and Patents applications cited in this specification themselves constitute portions of descriptions in this specification.

EXAMPLE 1

FIG. 1 is a configuration diagram illustrating the entirety of an air-conditioner test drive system in a case where the present invention is applied to a mobile terminal.

The air-conditioner test drive system illustrated in FIG. 1 is configured by outdoor machines 1 (1*a* and 1*b*), indoor machines 2 (2*a*-1 to 2*a*-3 and 2*b*-1 to 2*b*-3), a centralized control device 3, a radio adaptor 4, a mobile terminal 5, an air-conditioner communication transmission line 6, a wide-area radio base station 7, the Internet 8, a management server 9, an information terminal 10, and a printer 11.

The outdoor machine 1 and the indoor machine 2 are connected to each other by a refrigerant pipe, so as to form a refrigeration cycle. In FIG. 1, two outdoor machines 1 and six indoor machines 2 are provided. However, it is not limited to this combination, and one or more outdoor machines and one or more indoor machines may be provided. A remote controller is connected to the indoor machine 2, but illustration thereof is omitted in FIG. 1.

The outdoor machine 1 includes sensors for an outside air temperature, a compressor discharged-gas pipe temperature, a heat exchanger pipe temperature, high pressure, low pressure, and the like, and thus can measure monitored physical quantities of the above-described temperature and pressure. The indoor machine 2 includes sensors for a suction air temperature, a blowing air temperature, a refrigerant-gas pipe temperature, a refrigerant-liquid pipe temperature, and the like, and thus can measure monitored physical quantities of the above-described temperature.

The centralized control device 3 is connected to the outdoor machine 1 and the indoor machine 2 through the air-conditioner communication transmission line 6, and monitors and controls the connected devices. For example, the centralized control device 3 can switch an operation mode between operating and stopping or between cooling and heating, change a setting temperature, change a wind direction or an air volume, set an operation of a remote controller to be prohibited, set scheduling, and the like, for a single or a plurality of devices. The centralized control device 3 can display a state of the connected device or display an alarm.

The radio adaptor 4 is connected to the outdoor machine and the indoor machine 2 through the air-conditioner communication transmission line 6. The radio adaptor 4 performs exchange of data with the mobile terminal 5 by radio communication. As a radio communication scheme, for example, WiFi (registered trademark), Bluetooth (registered trademark), and Zigbee (registered trademark) may be used. A configuration in which a radio access point (radio base station) is provided between the radio adaptor 4 and the mobile terminal 5 may be made. The radio adaptor 4 controls the outdoor machine 1 and the indoor machine 2, and transmits operation information acquired from the outdoor machine 1 and the indoor machine 2, to the mobile terminal 5 in accordance with an instruction of the mobile terminal 5.

Here, the operation information means information for determining an operation state of the air conditioner. Such information includes pressure on high pressure side, pressure on low pressure side, an outside air temperature, and an operating frequency of a compressor, a total frequency in a case where a plurality of compressors is provided, an inverter primary current, an inverter secondary current, a compressor discharged-gas pipe temperature, a fan operation state, an expansion-valve opening degree, and a heat exchanger pipe temperature in a case of the outdoor machine. In a case of the indoor machine, the operation information means information for determining the operation state of the air conditioner, such as a suction air temperature, a blowing air temperature, a temperature difference between the suction air temperature and the blowing air temperature, a setting temperature, an operation mode, a setting air volume, a refrigerant-liquid pipe temperature, a refrigerant-gas pipe temperature, an alarm code, a remote thermistor, and an expansion-valve opening degree. The information is an example, and is not limited thereto.

The radio adaptor 4 may be attached to the air conditioner (outdoor machine 1, indoor machine 2, centralized control device 3, and the like). If the air conditioner can have a function as the radio adaptor 4, the radio adaptor 4 may be configured as one function of the air conditioner.

The mobile terminal 5 can be connected to the Internet 8 through the wide-area radio base station 7. As a radio communication scheme, for example, 3G (3rd Generation), LTE (registered trademark), and WiMAX (registered trademark) may be used.

The management server 9 is connected to the Internet 8, and performs data exchange with the mobile terminal 5. The management server 9 holds connection information and the like of the air conditioner, which has been transmitted from the mobile terminal 5. The management server 9 holds a database for each device type of the air conditioner, and performs transmission to the mobile terminal 5 in accordance with an instruction of the mobile terminal 5.

The information terminal 10 is connected to the Internet 8, and can communicate with the management server 9. A data base for each device type of the air conditioner, which has held in the management server 9 can be updated with reference to connection information of the air conditioner and the database for each device type of the air conditioner, which have been held in the management server 9, by using the information terminal 10.

The printer 11 is connected to the Internet 8, and can communicate with the mobile terminal 5 or the information terminal 10. The printer 11 can output contents displayed in the mobile terminal 5 to the printer 11, in accordance with an instruction of the mobile terminal 5.

The air-conditioner test drive system may include ventilation equipment in addition to the above-described components.

Figure 2:
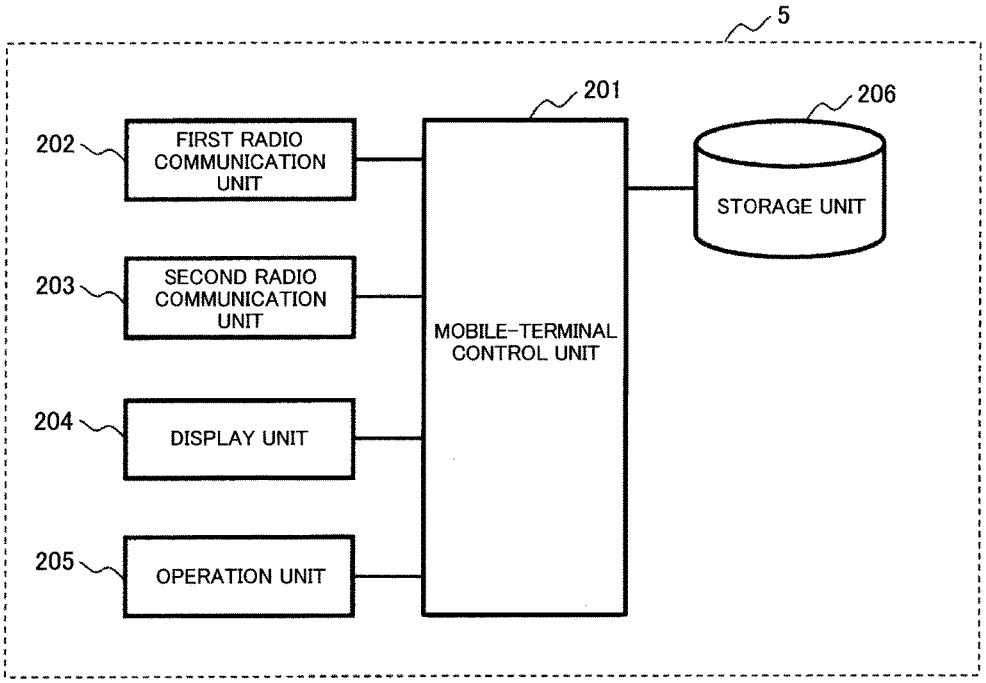
FIG. 2 is a functional block diagram illustrating a mobile terminal 5 which is used as a display device of operation information.

FIG. 2 is a functional block diagram of the mobile terminal 5 in the air-conditioner test drive system.

A mobile-terminal control unit 201 included in the mobile terminal 5 controls a first radio communication unit 202, a second radio communication unit 203, a display unit 204, an operation unit 205, and a storage unit 206. The first radio communication unit 202 performs radio communication with the radio adaptor 4. As a radio communication scheme, for example, WiFi (registered trademark), Bluetooth (registered trademark), and Zigbee (registered trademark) may be used. The second radio communication unit 203 is connected to the Internet 8 through the wide-area radio base station 7. As a radio communication scheme, for example, 3G (3rd Generation), LTE (registered trademark), and WiMAX (registered trademark) may be used.

The display unit 204 is configured from a liquid crystal display (LCD), a light emitting diode (LED), or the like. The display unit 204 displays various types of information. The operation unit 205 is configured from a button, a switch, a touch panel, and the like. The operation unit 205 receives an input from a user. The storage unit 206 stores a control program or various setting values of the mobile terminal 5, pieces of operation information of the outdoor machine 1 and the indoor machine 2, which have acquired from the radio adaptor 4, and information acquired from the management server 9. The control program of the mobile terminal 5 includes an air conditioner test-drive program of communicating with the radio adaptor 4 so as to perform a test drive of the air conditioner and to display operation information. The air conditioner test-drive program may be pre-installed on the mobile terminal 5 or may be downloaded from the management server 9. The display unit 204, the operation unit 205, and the storage unit 206 may be configured so as to be devices separated from each other. The display unit 204 and the operation unit 205 may be integrated like a touch panel.

The mobile terminal 5 as the display device to which the present invention is applied may acquire operation information of the air conditioner by any means. Thus, communication with the management server 9 is not necessary in the above configuration, and the second radio communication unit 203 may be not provided. In the following descriptions, the operation information of the air conditioner is acquired from the radio adaptor 4 through the first radio communication unit 202. However, in a case where means for acquiring the operation information from the air conditioner is separately provided, the first radio communication unit 202 may be replaced with another information communication means.

Figure 3:
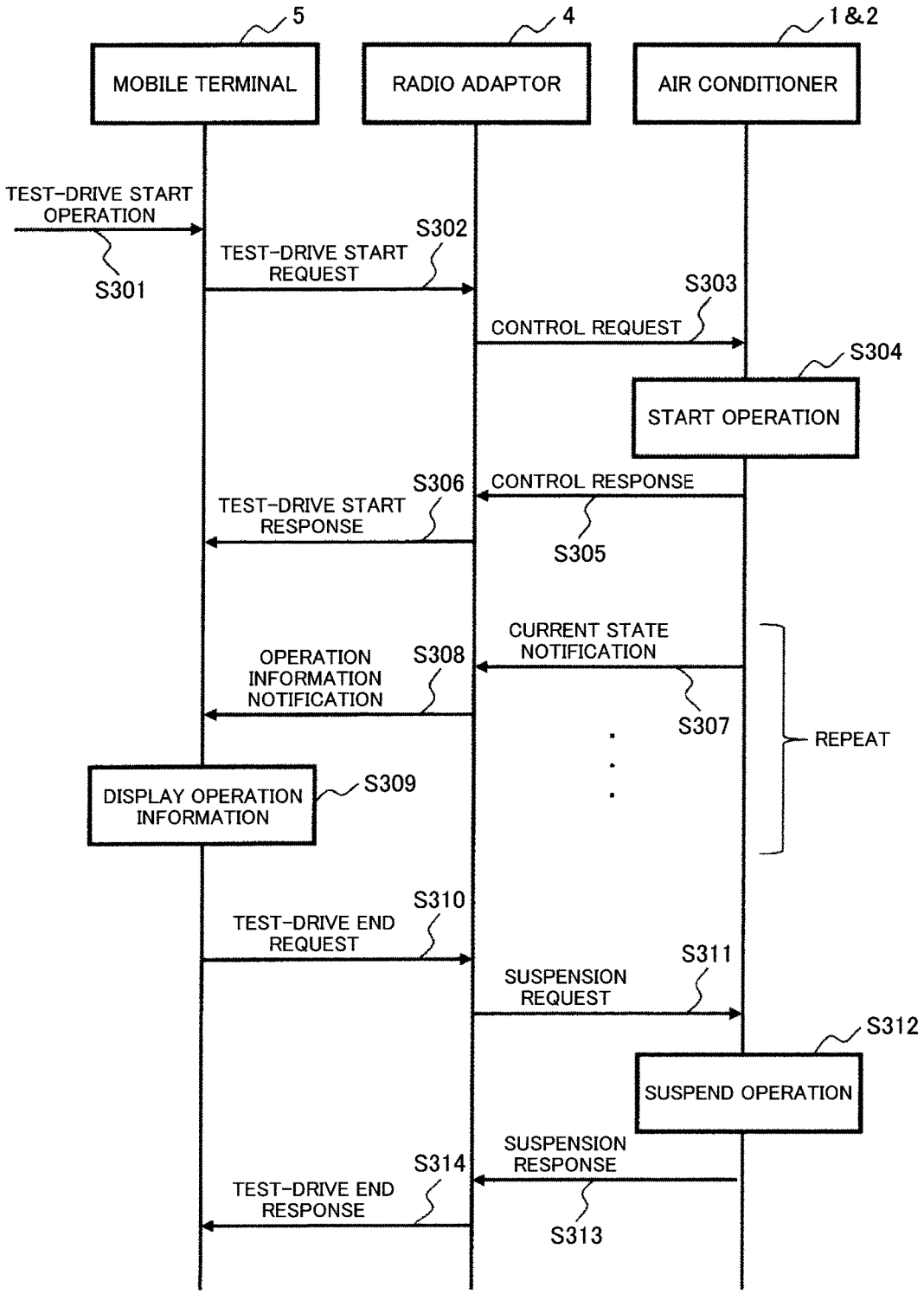
FIG. 3 is a sequence diagram when the mobile terminal 5 communicates with a radio adaptor 4.

FIG. 3 is an example of a sequence diagram when the mobile terminal 5 communicates with the radio adaptor 4 so as to perform the test drive of the air conditioner and to display operation information.

In the following descriptions, communication between the mobile terminal 5 and the radio adaptor 4 is performed through the first radio communication unit 202. The mobile-terminal control unit 201 is operated in accordance with the air conditioner test-drive program of the mobile terminal 5, and thus an operation of the mobile terminal 5 is executed. Communication between the radio adaptor 4 and the air conditioner (outdoor machine 1 and indoor machine 2) is performed through the air-conditioner communication transmission line 6. Only one air conditioner is illustrated in FIG. 3. However, it is assumed that similar communication is performed with each air conditioner.

If a user performs a test-drive start operation of the air conditioner on the operation unit 205 (S301), the mobile terminal 5 transmits a test-drive start request signal to the radio adaptor 4 (S302).

If the radio adaptor 4 receives the test-drive start request signal, the radio adaptor 4 transmits a control request signal to the air conditioner (outdoor machine 1 or indoor machine 2) which is set as a target of the test drive (S303).

If the air conditioner receives the control request signal, the air conditioner starts a test-drive operation (S304) transmits a control response signal to the radio adaptor 4 (S305). Settings such as an operation mode or capability in the test drive, and an operating time may be included in the test-drive start request signal or the control request signal, or may be set in advance by a remote controller and the like.

If the radio adaptor 4 receives the control response signal from the air conditioner, the radio adaptor 4 transmits a test-drive start response signal to the mobile terminal 5 (S306).

The air conditioner (outdoor machine 1 or indoor machine 2) which has started the test-drive operation transmits a current-state notification signal to the radio adaptor 4 periodically or in a case where a predetermined state of the air conditioner is changed (S307). The current-state notification signal includes operation information of the air conditioner at a time when the current-state notification signal is transmitted.

If the radio adaptor 4 receives the current-state notification signal, the radio adaptor 4 checks the contents thereof, extracts the operation information and transmits an operation information notification signal to the mobile terminal 5 (S308).

If the mobile terminal 5 receives the operation information notification signal from the radio adaptor 4, the mobile terminal 5 stores the operation information in the storage unit 206, and displays the operation information (S309). At this time, the mobile terminal 5 determines whether abnormality does not occur, based on the stored operation information. The mobile terminal 5 performs predetermined display in accordance with a determination result. Not the mobile terminal 5 but the air conditioner side may perform the determination based on the stored operation information, and may transmit a determination result to the mobile terminal 5.

FIG. 7 is an example of a connection information table 700 of the air conditioner, which is stored in the storage unit 206. An identifier (ID) of each of the outdoor machine and the indoor machine, and information of a refrigerant system (group connected by the same refrigerant pipe) are included in the table 700. In addition, an address for identifying a device in the same refrigerant system and information indicating the type of the device are stored in the table 700.

FIG. 8 is an example of a table 800 of the operation information stored in the storage unit 206. The operation information is stored in association with an identifier of the air conditioner and time-point information. All pieces of data which are received by transmission are not necessarily stored as the operation information, and information required for display or determination of abnormality may be stored as the operation information. The identifier of the air conditioner is information (ID) which is obtained, for example, from connection information of the air conditioner as illustrated in FIG. 7, and is used for identifying an individual outdoor machine 1 or an individual indoor machine 2 which is connected to the system. The connection information of the air conditioner may be input in advance, or may be acquired from the radio adaptor 4.

The operation information notification signal (S308) which is received from the radio adaptor 4 by the mobile terminal 5 includes an ID for specifying a device, a code indicating the type of the operation information, data of the operation information, a time point, an alarm code, and the like. The time point may be time-point information which has been added in the air conditioner which is a transmission source, or may be a reception time point of the radio adaptor 4. The ID for specifying a device may be, for example, a set of a refrigerant system number and an address number, an IP address of a device, or the like, in addition to an ID illustrated in FIG. 7. In a case of the IP address, an individual correspondence table with an ID of a device illustrated in FIG. 7 is necessarily provided. The alarm code indicates a code corresponding to an abnormality determination result.

In the above descriptions, the descriptions are made on the assumption that pieces of data in the tables in FIGS. 7 and 8 are stored in the storage unit 206 of the mobile terminal 5. As another method, the pieces of data in the tables may be stored in a storage device on the outside of the mobile terminal 5, and the mobile terminal 5 may be connected to the storage device in a wired or wireless manner. If the data is stored in such a manner, it is possible to reduce capacity of the storage device in the mobile terminal. However, a display speed is delayed by a transmission time of the data.

The above steps of S307 to S309 are repeated until the test drive is ended.

In a case where it is determined that abnormality has occurred in the air conditioner, based on S308 of operation information notification, the mobile-terminal 5 transmits a test-drive end request signal to the radio adaptor 4 (S310).

If the radio adaptor 4 receives a test-drive end request signal, the radio adaptor 4 transmits a suspension request signal to the air conditioner (outdoor machine 1 or indoor machine 2) which is set as a target of the test drive (S311).

If the air conditioner receives the suspension request signal, the air conditioner suspends the test-drive operation (S312), and transmits a suspension response signal to the radio adaptor 4 (S313).

If the radio adaptor 4 receives the suspension response signal from the air conditioner, the radio adaptor 4 transmits a test-drive end response signal to the mobile terminal 5 (S314).

The above-described sequences are an example. The start of the test drive is not limited to being performed from the mobile terminal 5, and may be performed from another constituent device such as the centralized control device 3. The control of the air conditioner is also not limited to being performed from the radio adaptor 4, and may be performed from another constituent device such as the centralized control device 3.

A communication procedure between nodes may be a push type or a pull type. For example, transmission of the operation information notification signal to the mobile terminal 5 from the radio adaptor 4 is not limited to the push type, and may be performed in the pull type in which an operation information request signal is transmitted from the mobile terminal 5.

The determination of abnormality in Step S309 may be performed in not the mobile terminal 5, but a control unit of the air conditioner (outdoor machine 1 or indoor machine 2) which reads a measured value of the operation information. In addition, the operation information may be transmitted to the management server 9 or the radio adaptor 4, and thus the management server 9 or the radio adaptor 4 which receives the transmitted operation information may perform the determination. In a case where the determination of abnormality is performed in a device other than the mobile terminal 5, the operation information notification signal to be transmitted to the mobile terminal 5 may include abnormality determination result information. In addition, the abnormality determination result information may be sent individually from the operation information notification signal. These can be designed in accordance with information processing capability or cost of each of the devices. A device which performs abnormality determination processing does not influence the action and the advantage of the present invention. Thus, in this specification, descriptions will be made on the assumption that the concept of the abnormality determination processing in the mobile terminal 5 includes both of a case where the abnormality determination processing is performed in the mobile terminal 5, and a case where the mobile terminal 5 receives a result of the abnormality determination processing which has been performed in another device, from the outside of the mobile terminal 5.

The steps of S310 to S314 are not necessary. For example, the steps of S310 to S314 may be performed only in a case where immediate operation suspension is desired, for example, in a case where damage of the device may be caused due to the operation continuing.

Thus, the user can sequentially recognize a test drive situation on the mobile terminal. That is, instead of an expensive dedicated device for a test drive, an inexpensive mobile terminal which is widely used, such as a smart phone is used as an operation information display device, and thus it is possible to reduce cost in the test drive. Even a configuration for a building or a hotel, or tenants, in which a plurality of outdoor machines and indoor machines are separately installed, may be possible as long as the outdoor machines and indoor machines are in a communication range, and a need for moving is reduced. Thus, a burden on a user is reduced.

Figure 4:
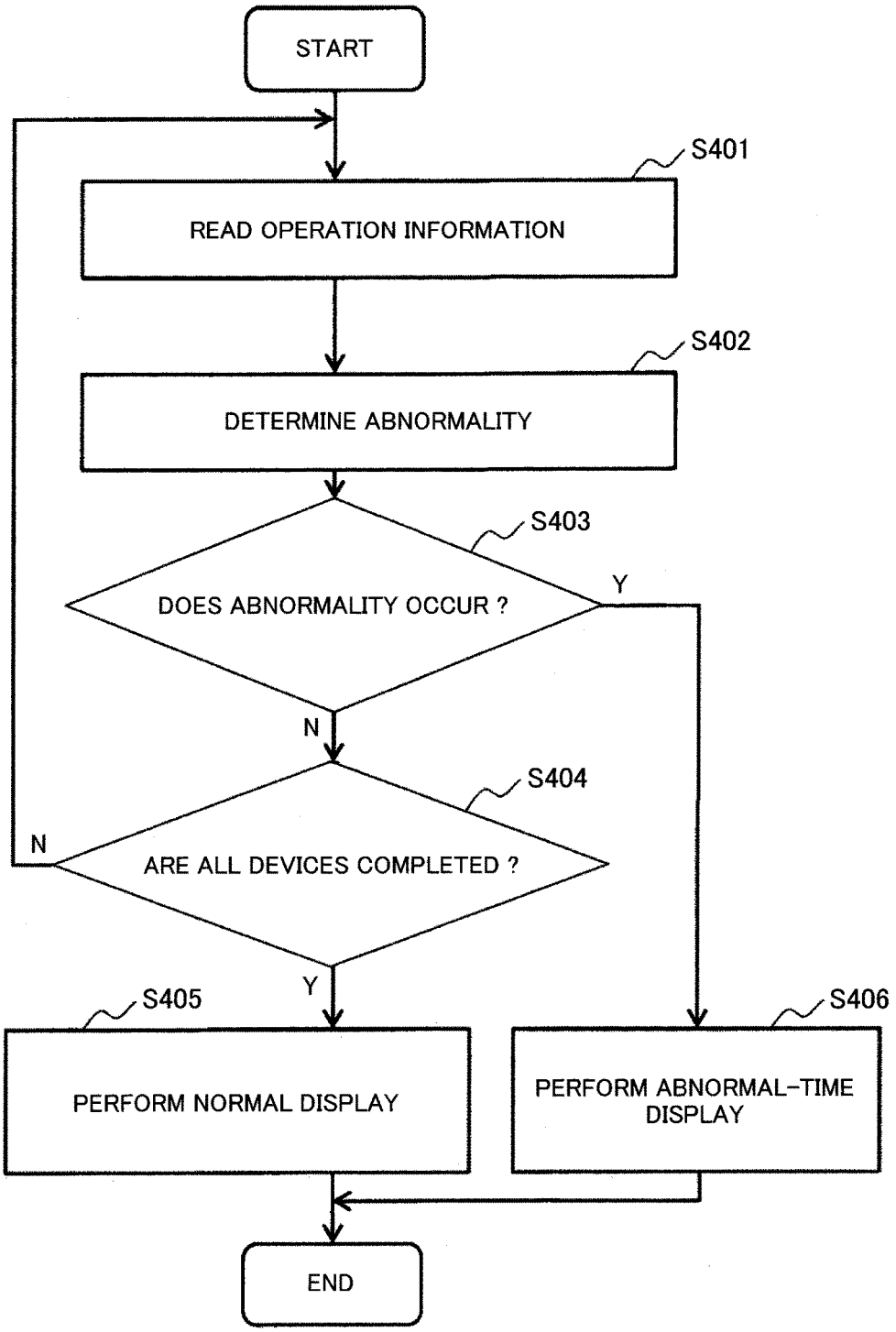
FIG. 4 is a flowchart when operation information is displayed in Step S309.

FIG. 4 is an example of a flowchart when the operation information is displayed in Step S309.

In Step S401, the mobile-terminal control unit 201 sequentially reads pieces of operation information of the air conditioner as a test drive target, from the storage unit 206. Here, the operation information to be read is operation information in a range of at least the type and a time in which abnormality of the air conditioner is recognizable.

In Step S402, the mobile-terminal control unit 201 determines whether or not abnormality has occurred in the air conditioner as the test drive target by using the operation information which has been read.

A specific example of an abnormality determination method will be described below. This example can be applied to a case of using any operation information.

A method as follows is considered. Regarding predetermined operation information of the air conditioner as a test-drive determination target, a predetermined upper limit value is determined in advance. In a case where the operation information exceeds the upper limit value, or in a case where the operation information continuously exceeds the upper limit value for a predetermined period, it is determined that the abnormality has occurred. Further, a method of determining that the abnormality has occurred, in a case where the situation of exceeding the upper limit value occurs a predetermined number of times is also considered. Conversely, a method of determining to be normal, in a case where exceeding the upper limit value never once occurs for a predetermined period is considered.

As another example, a method as follows is considered. Regarding predetermined operation information of the air conditioner as a test-drive determination target, a predetermined lower limit value is determined in advance. In a case where the operation information is less than the lower limit value or in a case where the operation information is continuously less than the lower limit value for a predetermined period, it is determined that the abnormality has occurred. Further, a method of determining that the abnormality has occurred, in a case where the situation of being less than the lower limit value occurs a predetermined number of times is also considered. Conversely, a method of determining to be normal, in a case where being less than the lower limit value never once occurs for a predetermined period is considered. As still another example, determination by using a combination of the upper limit value and the lower limit value is also considered.

As still another example, a method as follows is considered. Regarding predetermined operation information of the air conditioner as a test-drive determination target, a normal range is determined in advance. In a case where a parameter value does not reach the normal range for a predetermined period, it is determined that the abnormality has occurred. Conversely, a method of determining to be normal, in a case where the parameter value reaches the normal range for a predetermined period is considered. As still another example, a method of changing the above-described various determination value (upper limit value, lower limit value, and the like) in accordance with the setting temperature, the operation mode, and air volume setting is also considered. Further, it is determined that the abnormality has occurred, in a case where the alarm code indicates certain abnormality.

In the above-described abnormality determination methods, determination can be performed in combination of determination using a single pieces or plural pieces of predetermined operation information.

In a case where the determination of abnormality is performed in a device other than the mobile terminal 5, the abnormality determination result information included in operation information is read. Thus, this case is equal to a case where the determination of abnormality is performed in the mobile terminal 5. In this case, the process of S402 of abnormality determination in FIG. 4 is not performed in the mobile terminal 5. Instead, a determination result obtained by the determination in a device other than the mobile terminal 5 is input to the mobile terminal 5 in a form of being added to the operation information.

In the above described operation information, the operating frequency, the outside air temperature, the inverter primary current, the inverter secondary current, the total value of operating frequencies in a case where a plurality of outdoor machines is provided, the high pressure, the low pressure, the suction air temperature, the blowing air temperature, the temperature difference between the suction air temperature and the blowing air temperature, and the setting temperature are particularly important parameters for determining whether or not an operation of the air conditioner is normal.

In a case where the mobile-terminal control unit 201 does not determine that the abnormality has occurred, in Step S403, the process proceeds to Step S404. In a case where the mobile-terminal control unit 201 determines that the abnormality has occurred, the process proceeds to Step S406.

In Step S404, the mobile-terminal control unit 201 determines whether the steps of S401 to S403 are performed on all air conditioners as the test-drive determination target. In a case where the steps are ended in all of the air conditioners, the process proceeds to Step S405. In a case of being not completed, the process returns to Step S401 for the next air conditioner, and processes of Steps S401 to S403 are repeated.

In Step S405, the mobile-terminal control unit 201 controls the display unit 204 to perform normal operation information display.

In Step S406, the mobile-terminal control unit 201 controls the display unit 204 to perform abnormal operation information display.

Next, details of the operation information display will be described.

Figure 5:
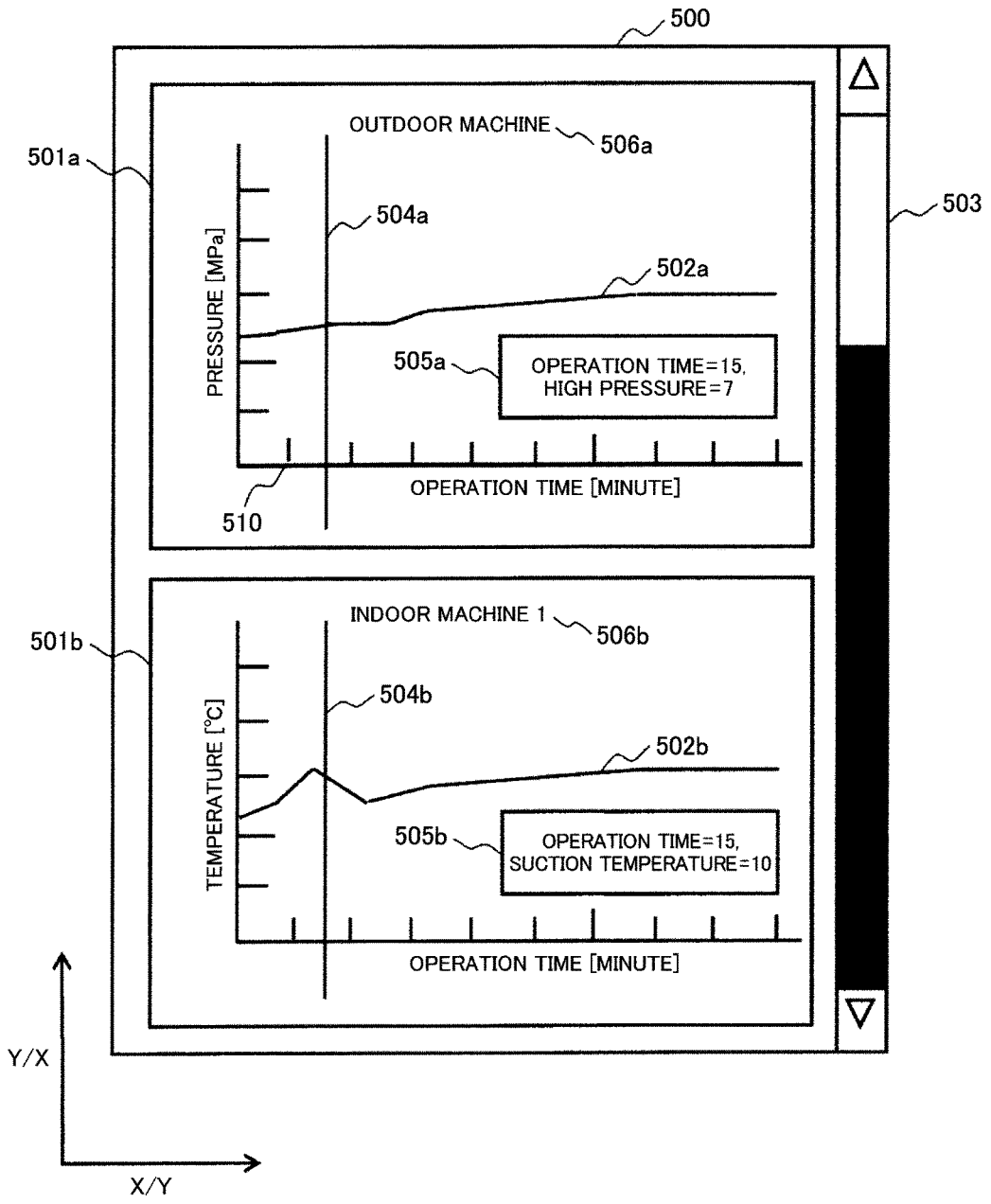
FIG. 5 is a plan view of a screen example on which operation information during a normal operation is displayed in Step S405.

FIG. 5 is an example of a screen for displaying normal operation information in Step S405. The screen is displayed in the display unit 204 of the mobile terminal 5.

A user performs a predetermined operation on the operation unit 205, and thus the mobile-terminal control unit 201 receives the operation signal, and the air conditioner test-drive program is started. The air conditioner test-drive program is an application program executed by the mobile-terminal control unit 201. If a test drive is started by a predetermined operation after the air conditioner test-drive program is started, the entirety of the system performs the sequences illustrated in FIG. 3. In the mobile terminal, the mobile-terminal control unit 201 displays at least two operation information display regions 501 in the display unit 204 (operation information display screen 500), in a line in the vertical direction. Preferably, the operation information display regions are displayed as large as each of the operation information display regions 501 is viewed. That is, when two operation information display regions 501 are displayed, it is desirable that a screen of the display unit 204 is equally divided into two parts, and all of the operation information display regions 501 are displayed in each of the parts. If the size of the screen is sufficiently large, three operation information display regions 501 or more may be displayed.

Here, the operation information display region 501 is a display region in which pieces of operation information of an individual outdoor machine 1 or indoor machine 2 are displayed in a graph. Plural pieces of operation information of the air conditioner may be displayed in the operation information display region 501.

The mobile-terminal control unit 201 in the mobile terminal (display device) 5 controls the display unit (operation information display screen 500) 204 to display a first operation information display region 501*a* and a second operation information display region 501*b* in line in the vertical direction or the transverse direction. The mobile-terminal control unit 201 displays time information in the transverse direction.

The mobile-terminal control unit 201 controls the display unit 204 to display first operation information (for example, pressure information on a high pressure side of the outdoor machine) corresponding to time information, in the first operation information display region 501*a*. The mobile-terminal control unit 201 controls the display unit 204 to display second operation information (for example, air temperature on a suction side of the indoor machine) corresponding to the time information, in the second operation information display region 501*b*.

In the above descriptions, the vertical direction and the transverse direction correspond to orthogonal coordinates defined on the operation information display screen 500. As a typical example, in a case where the operation information display screen 500 is rectangular, the vertical direction and the transverse direction may correspond to two sides which are orthogonal to each other. In a case of the mobile terminal 5, the posture of the device can be arbitrarily changed by a user, and thus length and height are relative concepts, and may be substituted with each other. In this specification, for convenient understandings, a horizontal direction viewed from a user is defined to be the transverse (x) direction.

In the present invention, a method for display is not particularly limited. However, as illustrated in FIG. 5, in a case where pieces of operation information are displayed in a graph, it is desirable that a horizontal direction viewed from an operator is defined to be the transverse direction, and the time information is displayed. That is, a transverse axis of the graph is set as a time axis, and pieces of operation information are illustrated in a vertical axis. A technology of using an acceleration sensor for detecting the posture of a mobile terminal has been already known. Thus, the time axis may be displayed in a horizontal direction to the ground based on information of the detected posture, on the assumption that a user stands up so as to be perpendicular to the ground.

FIG. 5 illustrates a display example in a case where the mobile terminal 5 including a display screen (liquid crystal display and the like) which has a long side and a short side is held to cause a long-side direction to be perpendicular to the ground. Two display regions 501 are arranged in the long-side direction. In a case where the mobile terminal 5 is rotated by 90 degrees, samely, the two display regions 501 may be also arranged in the long-side direction. Here, an operation information display region disposed at an upper portion of the screen is referred to as the first operation information display region 501*a*, and an operation information display region displayed under the first operation information display region 501*a* is referred to as the second operation information display region 501*b*. The mobile-terminal control unit 201 controls the display unit (operation information display screen 500) 204 to express each of the operation information display regions 501 in a graph formed by a transverse axis which indicates an operation time, and a vertical axis which indicates operation information. Here, the operation information expressed in the form of a graph is referred to as an operation information graph 502. In the example of FIG. 5, pressure 502*a* in the first operation information display region 501*a* is displayed as the operation information, and a temperature 502*b* in the second operation information display region 501*b* is displayed as the operation information.

The mobile terminal such as a smart phone has a screen which is vertically long, in many cases. Thus, as described above, the operation information display regions are disposed in the vertical direction, and thus it is possible to display a plurality of operation information display regions on the same screen without a problem, and to easily compare pieces of operation information between the different operation information display regions.

In order to also consider a case where the mobile terminal which is vertically long is used in a state of being side down in the transverse direction, in this case, the display unit 204 is desirably controlled to display the first operation information display region and the second operation information display region in line in the transverse direction. In the following descriptions, a case where the display regions are arranged in the vertical direction will be described. However, the present invention can be also similarly applied to a case where the display regions are arranged in the transverse direction.

In the example of FIG. 5, a test drive time which is important for determining a test drive situation is set to be a transverse axis in the plurality of operation information display regions 501, in the same scale. Thus, it is possible to immediately recognize pieces of operation information in the plurality of operation information display regions 501 which are arranged vertically or transversely, at the same time point, and to easily perform comparison. In particular, if the operation information display regions 501 are arranged vertically, the pieces of operation information at the same time point are recognized more easily.

In the air conditioner, the outdoor machine and the indoor machine operate in corporation with each other. Thus, pieces of operation information of the outdoor machine and the indoor machine are desirably displayed in line. Since a plurality of indoor machines is connected to one outdoor machine in many cases, a referring frequency of the operation information of the outdoor machine is high, and more important. Thus, the mobile-terminal control unit 201 desirably controls the display unit 204 to display the operation information of the outdoor machine 1 in the first operation information display region 501*a*, and to display the operation information of the indoor machine 2 in the second operation information display region 501*b*. Regarding an indoor machine which is displayed in the second operation information display region 501*b* among the plurality of indoor machines, an order may be predetermined and the indoor machines may be normally displayed in the constant order. In addition, a specific one indoor machine may be displayed. If an instruction from a user is provided, a certain indoor machine may be displayed.

As illustrated in FIG. 3, the mobile terminal 5 is controlled by the mobile-terminal control unit 201 so as to receive new operation information at a constant time interval from the radio adaptor 4 in the radio communication unit 202, to store the acquired operation information in the storage unit 206, and to update the operation information graph 502 displayed in the display unit 204, as an operation time elapses.

As a specific example, in the operation information display region 501, the time which is displayed corresponding to the transverse axis is displayed in each time display region (for example, an upper portion, a lower portion, or the like of a scale 510 in the transverse axis are assumed) at a predetermined time interval, such that the right side indicates late time, and the left side indicates old time. The display unit 204 is controlled by the mobile-terminal control unit 201 so as to display operation information corresponding to this.

For example, it is assumed that 10:00:00 is displayed in a first time-point display region, 10:00:20 is displayed in a second time-point display region on the right side of the first time-point display region, 10:00:40 is displayed in a third time-point display region on the right side of the second time-point display region, and the latest time point is displayed in the third time-point display region. With the above assumption, time point display is updated once for each of 20 seconds, and thus the latest time point (10:01:00) is displayed in the third time-point display region, 10:00:40 is displayed in the second time-point display region, and 10:00:20 is displayed in the first time-point display region on the left side of the second time-point display region.

That is, time points which are displayed corresponding to the transverse axis in a predetermined cycle are updated to be the latest time points, and pieces of operation information corresponding to the time points are also updated. The display unit 204 is controlled by the mobile-terminal control unit 201 so as not to display a time point in the display unit, after the time point is displayed in the oldest time-point display region. Thus, a user can normally recognize the latest operation time, and recognize a flow of pieces of operation information for the operation time.

If a scroll operation is performed on the operation unit 205 in the old time direction in the transverse direction, the mobile-terminal control unit 201 receives the scroll operation, and controls the display unit 204 to change a time-point display of the time-point display region in the transverse axis toward the old time points, in accordance with the degree of the scroll operation, and to display operation information corresponding to this. Conversely, if a scroll operation is performed on the operation unit 205 from this state in a new time direction, the mobile-terminal control unit 201 receives the scroll operation, and controls the display unit 204 to change a time-point display of the time-point display region in the transverse axis toward the new time points, in accordance with the degree of the scroll operation, and to display operation information corresponding to this. Accordingly, a user can also easily recognize the previous operation information.

The display unit (operation information display screen 500) 204 is controlled to display the name of an air conditioner having operation information which is displayed in the operation information display region 501, at a position of any of the operation information display regions 501. In the example of FIG. 5, air conditioner names 506*a* and 506*b* are displayed at upper portions of the operation information display regions 501*a* and 501*b*, respectively. A configuration in which a plurality of indoor machines is linked to one outdoor machine is assumed, and an air conditioner name of the outdoor machine is described as an outdoor machine, and air conditioner names of the indoor machines are described as Indoor machine 1 and Indoor machine 2.

The scroll bar 503 is used for changing an air conditioner displayed in the first operation information display region or the second operation information display region. That is, in a case where a scroll operation is performed on a scroll bar (scroll means) 503 by a user, the mobile-terminal control unit 201 controls the display unit 204 to display operation information of an air conditioner separate from the air conditioner which is current displayed, in the first or second operation information display region. As in FIG. 5, both of the first operation information display region 501*a* and the second operation information display region 501*b* may be scrolled by one scroll bar 503. In addition, the scroll bar 503 may be assigned to each of the operation information display regions, and scrolling can be individually performed on the operation information display regions.

As in FIG. 5, the scroll bar 503 may be formed in the vertical direction or be formed in the transverse direction. The scroll bar 503 is not a necessary component. For example, in a case where the mobile-terminal control unit 201 can perform control to perform a slide operation on the display unit 204 configured by a touch panel, and to move display contents of the display unit, the scroll bar 503 may be not provided. In a case where a pair of an outdoor machine and an indoor machine is normally displayed, the scroll bar 503 may cause only the plurality of indoor machines to be switched without changing the display of the outdoor machine. For example, the display of the first operation information display region 501*a* may be fixed, and only the second operation information display region 501*b* may be scrolled by the scroll bar 503.

As described above, operation information of an air conditioner, which has been not displayed can be displayed in the display unit 204 by the scroll, and thus pieces of operation information are easily confirmed on the small screen.

Here, in a case where a user of the mobile terminal (display device) 5 performs a selection operation of selecting a predetermined time among pieces of time information, on the operation unit 205, the mobile-terminal control unit 201 of the mobile terminal (display device) 5 controls the display unit 204 to display indicator information 504 which indicates a position of a first operation information (for example, pressure information on a high pressure side of the outdoor machine) or second operation information (for example, air temperature information on a suction side of the indoor machine) corresponding to the selected predetermined time. Preferably, the first and second operation information corresponding to the selected predetermined time is simultaneously displayed.

In addition, in a case where a user of the mobile terminal (display device) 5 performs a selection operation of selecting a certain place for the time-point display region indicating time information, in the first operation information display region 501*a* on the operation unit 205, the mobile-terminal control unit 201 of the mobile terminal (display device) 5 may control the display unit 204 to display indicator information 504 indicating a position of the time information or the operation information which corresponds to the selected place, in the first operation information display region 501*a*. The indicator information 504 may be a line illustrated in FIG. 5 or a marker having any form, as long as the indicator information indicates a position of operation information in the same operation time. It is desirable that display correspondence of the indicator information 504 is operated by the operation unit 205, and thus setting can be arbitrarily performed.

An operation time indicated by the indicator information 504 and a value of operation information corresponding to the time are displayed as indicated-position operation information 505, at any point of the operation information display region 501 by the mobile-terminal control unit 201. Control may be performed so as to dispose the indicated-position operation information 505 at a certain point in the operation information display region 501. For example, the indicated-position operation information 505 may be disposed so as to be close to the right end of the operation information display region 501 or to a position of an indicator. The value of the operation time and the value of operation information are not necessarily displayed at the same position, and may be controlled by the terminal control unit 201 so as to indicate each value on each axis. The indicated-position operation information 505 is controlled to be displayed in all of the operation information display region 501 in which pieces of indicator information 504 are provided.

A user can immediately know an accurate value of operation information corresponding to a predetermined operation time by using the indicator information 504 and the indicated-position operation information 505 displayed in the display unit 204, without reading the small scale of the graph.

Each air conditioner has multiple types of operation information. However, in an initial state after the mobile terminal 5 starts the air conditioner test-drive program, for example, the mobile-terminal control unit 201 may perform control to display only operation information regarding pressure for the outdoor machine and display only operation information regarding a temperature for the indoor machine. The user operates the operation unit 205, and thus the mobile-terminal control unit 201 may perform control to allow a change of operation information displayed on the display unit 204.

Thus, even when the display unit 204 is small, it is possible to improve visibility of necessary data.

Figure 6:
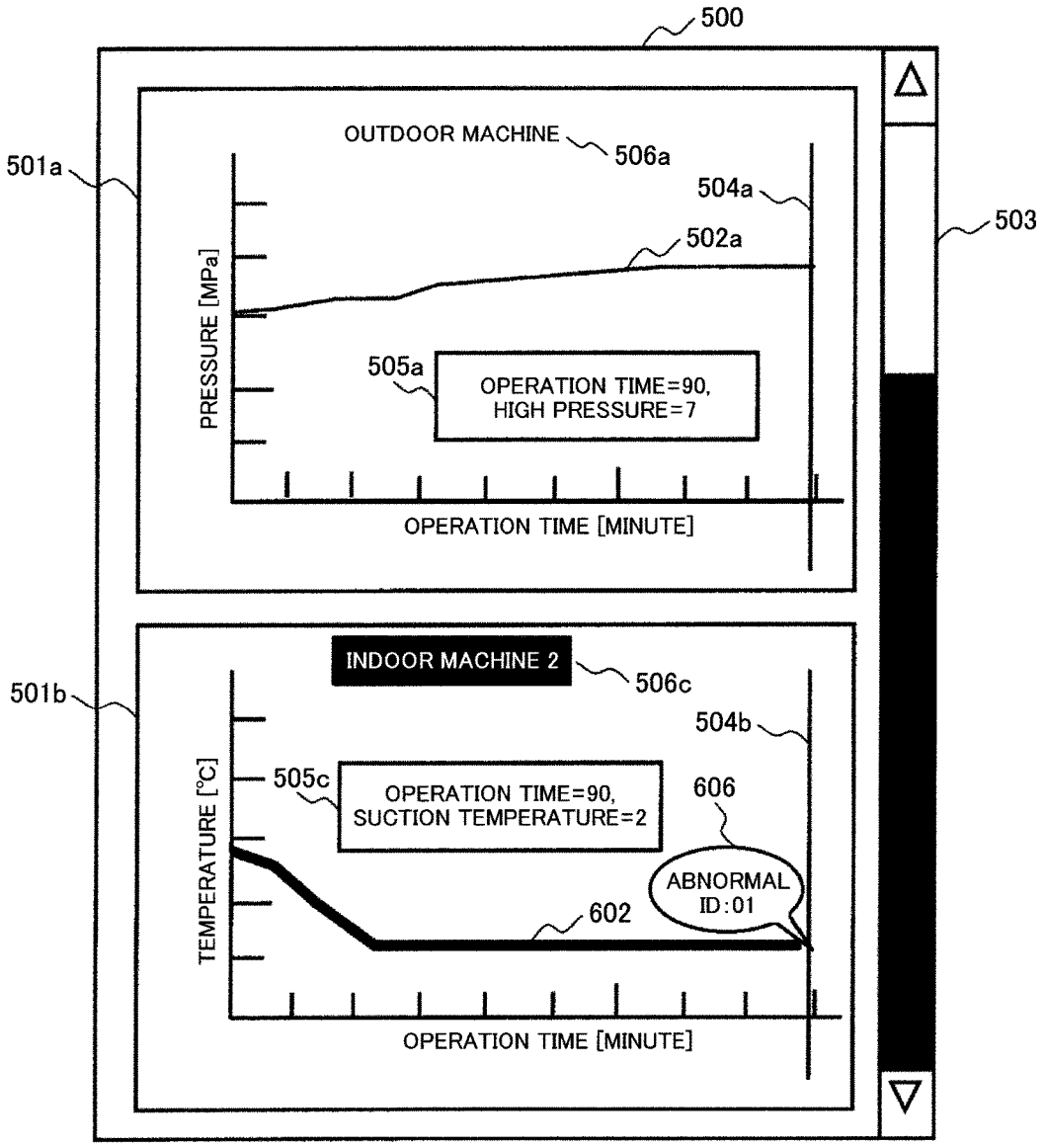
FIG. 6 is a plan view of a screen example on which operation information when abnormality occurs is displayed in Step S406.

FIG. 6 is an example of a screen on which operation information is displayed when abnormality has occurred, in Step S406. In FIG. 6, parts common with those in FIG. 5 are denoted by the same reference signs, and descriptions thereof will be omitted.

The mobile-terminal control unit 201 controls the display unit 204 to forcibly display operation information of a target air conditioner in which the mobile-terminal control unit 201 determines, in Step S403, that the abnormality has occurred, in the first operation information display region 501*a* or the second operation information display region 501*b*. For example, as illustrated in FIG. 5, when the suction air temperature of Indoor machine 1 is displayed in the second operation information display region at a normal time, in a case where it is determined that the abnormality, on the suction air temperature of Indoor machine 2 has occurred, as in FIG. 6, control is performed so as to display suction air temperatures 602 and 505*c* of Indoor machine 2, instead of suction air temperatures 502*b* and 505*b* of Indoor machine 1 displayed in the second operation information display region. At this time, in order to avoid confusion of the user, it is desirable that the size or the position of the second operation information display region 501*b* is not changed.

The mobile-terminal control unit 201 controls the indicator information 504 and the indicated-position operation information 505 to indicate a time point of operation information of the target air conditioner in which the mobile-terminal control unit 201 determines that the abnormality has occurred, in Step S403.

The mobile-terminal control unit 201 highlight-displays display components 602 and 505*c* and the like of the operation information display region in which the operation information of the target air conditioner in which the mobile-terminal control unit 201 determines, in Step S403, that the abnormality has occurred is displayed.

Here, examples of the highlight display include changing a thickness of a line or a style of a broken line and the like, changing colors including a background, changing a type and a size of font, changing a scaling ratio between a vertical axis and a transverse axis, changing a display range, and blinking display. FIG. 6 illustrates an example of highlight display performed by reversing the color of the air conditioner name 506*c* displayed at an upper portion of the second operation information display region 501*b*, and of highlight display performed by the operation information graph 602 having a thick line.

The mobile-terminal control unit 201 controls the abnormality notification information 606 for a notification that the abnormality has occurred to be displayed in the operation information display screen 500. The abnormality notification information 606 is desirably displayed in the vicinity of the operation information graph 602 in the operation information display region in which the operation information of the target air conditioner in which the mobile-terminal control unit 201 determines, in Step S403, that the abnormality has occurred, particularly, in the vicinity of a time point when the abnormality has occurred. Here, the abnormality notification information 606 is an icon or a label which is easy to be visually recognized and is used for a notification that the abnormality has occurred. The abnormality notification information 606 displays the type of the abnormality.

Table 1 is a table illustrating an example of controlling display contents of the operation information display screen 500. In a normal state, high-pressure side pressure of the outdoor machine 1*a* in FIG. 1 is displayed in the first operation information display region 501*a*, and the suction air temperature of the indoor machine 2*a*-1 which is connected to the outdoor machine 1*a* is displayed in the second operation information display region 501*b*. The type of operation information to be displayed may be set by arbitrarily selecting information which is most frequently used. Since the plurality of indoor machines is provided, the indoor machines 2*a*-1 to 2*a*-3 may be switched at a predetermined interval. In addition, the indoor machine 2*a*-1 may be displayed in an initial state, and then the indoor machines 2*a*-1 to 2*a*-3 may be switched manually.

machine, as operation information having high relevance with the temperature difference. If the association is performed, when abnormality is determined based on the temperature difference between the suction air temperature and the blowing air temperature of the indoor machine, and this information is displayed, the low-pressure side pressure of the outdoor machine is simultaneously displayed. Thus, the cause of the abnormality is easily determined.

TABLE 1

| State | Display of first operation information display region 501a | Display of second operation information display region 501b |
|---|---|---|
| Default (normal state) | High-pressure side pressure of outdoor machine 1a | Suction air temperature of indoor machine 2a-1 |
| Determination of abnormality in inverter primary current of outdoor machine 1a | Inverter primary current of outdoor machine 1a | Suction air temperature of indoor machine 2a-1 |
| Determination of abnormality in setting air volume of indoor machine 2a-2 | High-pressure side pressure of outdoor machine 1a | Setting air volume of indoor machine 2a-2 |
| Determination of abnormality in inverter primary current of outdoor machine 1b | Inverter primary current of outdoor machine 1b | Suction air temperature of indoor machine 2b-1 |
| Determination of abnormality in setting air volume of indoor machine 2a-2 | High-pressure side pressure of outdoor machine 1b | Setting air volume of indoor machine 2b-2 |
| Determination of abnormality in temperature difference between suction air temperature and blowing air temperature of indoor machine 2a-1 | Low-pressure side pressure of outdoor machine 1a | Temperature difference between suction air temperature and blowing air temperature of indoor machine 2a-1 |

In a case where the determination of abnormality is performed, the above state is switched as in Table 1, for example. It is desirable that a pair of the outdoor machine and the indoor machine which is connected to the outdoor machine by the refrigerant pipe and the like is normally displayed. The outdoor machine and the indoor machine have an influence on each other in many cases. Accordingly, pieces of information of both of the outdoor machine and the indoor machine are simultaneously checked, and thus a situation of the abnormality is easily recognized. As illustrated in FIGS. 5 and 6, pieces of information of the outdoor machine and the indoor machine are displayed in line in a time axis which is aligned in the same screen. Thus, recognition becomes easier. A relationship between the outdoor machine and the indoor machine can be searched for, based on the connection information (see FIG. 7) of the air conditioner, which is stored in the storage unit 206.

In the example of Table 1, operation information (relating to determination of abnormality) of a device in which the determination of abnormality is performed is normally displayed. In addition, an indoor machine or an outdoor machine which is connected to the device in which the determination of abnormality is performed is simultaneously shown. A portion to which a mark of • is added in Table 1 corresponds to operation information of the device in which abnormality is shown. Thus, a user can immediately view necessary information such as information indicating the abnormality. Since it is possible to simultaneously view pieces of information of an outdoor machine and an indoor machine which relate to each other, a cause of the abnormality is easily determined. In a case where specific operation information of an indoor machine and specific operation information of an outdoor machine are associated with each other, and one operation information is displayed by determination of abnormality, another piece of operation information may be automatically displayed. For example, low-pressure side pressure of an outdoor machine is associated with a temperature difference between the suction air temperature and the blowing air temperature of an indoor As described above, according to the display device applied to the mobile terminal 5 of the example, in a case where the abnormality has occurred, operation information of an air conditioner in which the abnormality has occurred is highlighted and displayed so as to be comprehensible without an operation of a scroll and the like by a user. Thus, the user can immediately confirm pieces of operation information of the outdoor machine and the indoor machine relating to an abnormality occurrence place.

EXAMPLE 2

In this example, in a case where the abnormality has occurred in an air conditioner, vibration and warning sound are generated in addition to highlight display of operation information.

Figure 9:
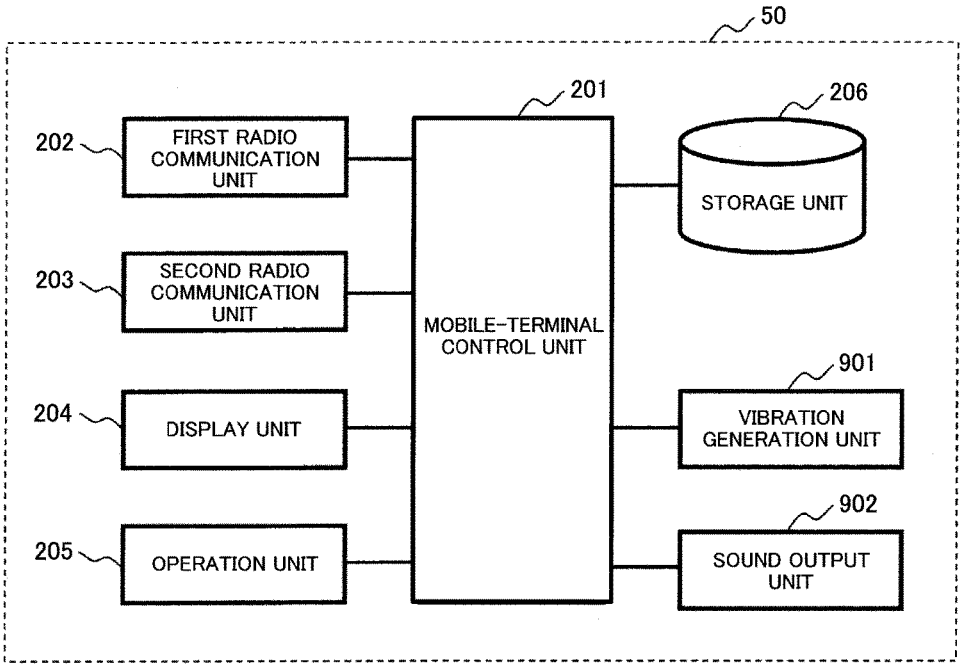
FIG. 9 is a functional block diagram illustrating a mobile terminal 50 which is used as a display device of operation information.

FIG. 9 is a functional block diagram of a mobile terminal 50 which is a display device according to this example. In FIG. 9, parts common with those in the mobile terminal 5 which is the display device according to Example 1 are denoted by the same reference signs, and descriptions thereof will be omitted.

The mobile terminal 50 includes a vibration generation unit 901 and a sound output unit 902 in addition to the configuration of the mobile terminal 5.

The process of Step S406 in FIG. 4 is different from that in Example 1. That is, the mobile-terminal control unit 201 controls the display unit 204 to display operation information at a time of abnormality. In addition, the mobile-terminal control unit 201 controls the vibration generation unit 901 to vibrate, and controls the sound output unit 902 to output warning sound.

As described above, in this example, vibration and warning sound are generated in addition to highlight display of operation information when the abnormality has occurred, and thus, a user can notice abnormal, for example, even when the user looks away from the screen.

The present invention is not limited to the above-described examples, and various modification examples are included. For example, the above-described examples are described in detail, in order to comprehensibly describe the present invention, and the present invention is not necessarily limited to a configuration including all of the described components. A portion of the configuration in one example can be substituted with the configuration in another example, and the configuration in another example can be added to the configuration in one example. Addition, deletion, and substitution of other components can be performed on a portion of the configuration of each of the examples.

Some or all of the components, the functions, the processing units, the processing means, and the like may be realized by hardware which is obtained by design with an integrated circuit, for example. The components, the functions, and the like may be realized by software in such a manner that a processor interprets and executes a program for realizing each function. Information such as the programs, the tables, and the files, which is used for realizing the functions can be stored in a recording device such as a memory, a hard disk, and a solid state drive (SSD), or a recording medium such as an IC card, an SD card, and a DVD.

Only a control line or an information line which is considered to be required for the descriptions is illustrated, and it is not necessarily limited to illustration for all control lines or information lines, in a product. It may be considered that almost all of the components are connected to each other in practice.

INDUSTRIAL CAPABILITY

The present invention can provide an information terminal which can easily recognize abnormality in a device during a test drive and the like of an air conditioner.

REFERENCE SIGNS LIST

1 OUTDOOR MACHINE
2 INDOOR MACHINE
3 CENTRALIZED CONTROL DEVICE
4 RADIO ADAPTOR
5 MOBILE TERMINAL
6 AIR-CONDITIONER COMMUNICATION TRANSMISSION LINE
7 WIDE-AREA RADIO BASE STATION
8 INTERNET
9 MANAGEMENT SERVER
10 INFORMATION TERMINAL
11 PRINTER
201 MOBILE-TERMINAL CONTROL UNIT
202 FIRST RADIO COMMUNICATION UNIT
203 SECOND RADIO COMMUNICATION UNIT
204 DISPLAY UNIT
205 OPERATION UNIT
206 STORAGE UNIT
901 VIBRATION GENERATION UNIT
902 SOUND OUTPUT UNIT
500 OPERATION INFORMATION DISPLAY SCREEN
501 OPERATION INFORMATION DISPLAY REGION
502, 602 OPERATION INFORMATION GRAPH
503 SCROLL BAR
504 INDICATOR INFORMATION
505 INDICATED-POSITION OPERATION INFORMATION
606 ABNORMALITY NOTIFICATION INFORMATION

The invention claimed is:

1. A display device which displays operation information of an air conditioner in which an outdoor machine including an outdoor heat exchanger and an indoor machine including an indoor heat exchanger are connected to each other by a refrigerant pipe, and a refrigerant is circulated by a compressor, the device comprising:

a control unit that determines whether or not abnormality occurs in the outdoor machine or the indoor machine when the air conditioner operates; and a display unit which is controlled by the control unit so as to display a plurality of operation information display regions for displaying time information and operation information corresponding to the time information in respective time-series graphs, wherein the control unit is configured to, upon determining that the abnormality has occurred in the outdoor machine or the indoor machine, control the display unit to display the operation information of the outdoor machine or the indoor machine in which the abnormality has occurred, in the operation information display region, control the display unit to display a first operation information display region and a second operation information display region in line in a vertical direction or a transverse direction, upon determining that the abnormality has occurred in the outdoor machine or the indoor machine, control the display unit to display operation information of the outdoor machine in the first operation information display region in a time-series graph, and to display operation information of the indoor machine, which is connected to the displayed outdoor machine by the refrigerant pipe, in the second operation information display region in a respective time-series graph, and display the operation information of the outdoor machine or the indoor machine in which the abnormality has occurred.

2. The display device according to claim 1, further comprising:

a vibration generation unit, wherein in a case where the control unit determines that the abnormality has occurred in the outdoor machine or the indoor machine, the control unit causes the vibration generation unit to vibrate.

3. The display device according to claim 1, further comprising:

a sound output unit, wherein in a case where the control unit determines that the abnormality has occurred in the outdoor machine or the indoor machine, the control unit causes the sound output unit to output warning sound.

4. The display device according to claim 1, wherein the operation information of the outdoor machine is any one of at least an operating frequency of the compressor, pressure on high pressure side, pressure on low pressure side, a primary current of an inverter, a secondary current of the inverter, an outside air temperature, and the total of operating frequencies of a plurality of compressors, and the operation information of the indoor machine is any one of at least a suction air temperature, a blowing air temperature, a temperature difference between the suction air temperature and the blowing air temperature, a setting temperature, an operation mode, and a setting air volume.

5. The display device according to claim 1, wherein in a case where the control unit determines that the abnormality has occurred in the outdoor machine or the indoor machine, the control unit controls the display unit to display the operation information of the outdoor machine or the indoor machine in which the abnormality has occurred, with highlight.

6. The display device according to claim 5, wherein the display with highlight is performed by any of at least changing a thickness and a style of a line, changing colors including a background, changing a type and a size of font, changing a scaling ratio between a vertical axis and a transverse axis, changing a display range, and blinking display.

7. The display device according to claim 1, further comprising:

a communication unit, wherein the outdoor machine and the indoor machine include a first group which includes a first outdoor machine and a plurality of first indoor machines connected to the first outdoor machine by a first refrigerant pipe, and a second group which includes a second outdoor machine and a plurality of second indoor machines connected to the second outdoor machine by a second refrigerant pipe, the communication unit periodically receives the operation information, and regardless of determination of whether or not the abnormality has occurred, the control unit causes the display unit to display the latest operation information among pieces of operation information which are periodically received, causes the display unit to display the first operation information display region and the second operation information display region in line, causes the display unit to display operation information of the outdoor machine belonging to any of the first and second groups in the first operation information display region, to display operation information of one of the plurality of indoor machines which belongs to the same group as that of the outdoor machine displayed in the first operation information display region, in the second operation information display region.

8. The display device according to claim 7, wherein in a case where the control unit does not determine that the abnormality has occurred, the control unit causes operation information of the first outdoor machine to be displayed in the first operation information display region, causes operation information of one of the plurality of first indoor machines to be displayed in the second operation information display region, in a case where it is determined that the abnormality has occurred in any of the second outdoor machine and the plurality of second indoor machines, the control unit causes operation information of the second outdoor machine to be displayed in the first operation information display region, and causes operation information of one of the plurality of second indoor machines to be displayed in the second operation information display region, and the operation information of the outdoor machine or the indoor machine in which the abnormality has occurred is included in the display.

9. The display device according to claim 1, wherein the control unit autonomously determines whether or not the abnormality has occurred in the outdoor machine or the indoor machine, based on the operation information, or performs the determination based on information which is input from an outside of the device, and indicates whether or not the abnormality has occurred in the outdoor machine or the indoor machine.

10. A display method which is performed in an information terminal including an input device, a display device, a processing device, and a storage device, and which displays operation information of an air conditioner in which an outdoor machine including an outdoor heat exchanger and an indoor machine including an indoor heat exchanger are connected to each other by a refrigerant pipe, and a refrigerant is circulated by a compressor, the method being implemented with memory-stored executable instructions coupled to a processor of the information terminal, where the executable instructions when executed by the processor, cause the processor to perform the method, comprising:

an acquisition step for causing the input device to acquire the operation information of the air conditioner;

a storing step for causing the storage device to store the acquired operation information;

an abnormality determination step for causing the processing device to determine whether or not abnormality has occurred in the outdoor machine or the indoor machine when the air conditioner operates; and a display step for causing the display device to display at least a first operation information display region and a second operation information display region for displaying time information and displaying operation information corresponding to the time information in respective time-series graphs, wherein in a case where, in the abnormality determination step, it is determined that the abnormality has occurred in the outdoor machine or the indoor machine, operation information of the outdoor machine or the indoor machine in which the abnormality has occurred, is displayed in the first or second operation information display region in the display step, the method further comprising:

displaying a first operation information display region and a second operation information in the display region in line in a vertical direction or a transverse direction, upon determining that the abnormality has occurred in the outdoor machine or the indoor machine, displaying operation information of the outdoor machine in the first operation information display region in a time-series graph, and displaying operation information of the indoor machine, which is connected to the displayed outdoor machine by the refrigerant pipe, in the second operation information display region in a respective time-series graph, and displaying the operation information of the outdoor machine or the indoor machine in which the abnormality has occurred.

11. The display method according to claim 10, wherein in the input device, an abnormality signal for a notification of whether or not the abnormality has occurred in the outdoor machine or the indoor machine is received along with the operation information or separately from the operation information, and in the abnormality determination step, the processing device determines whether or not the abnormality has occurred in the outdoor machine or the indoor machine, based on the abnormality signal.

12. The display method according to claim 10, wherein the outdoor machine and the indoor machine include at least a first group which includes a first outdoor machine and a plurality of first indoor machines connected to the first outdoor machine, and a second group which includes a second outdoor machine and a plurality of second indoor machines connected to the second outdoor machine, in a case where it is not determined, in the abnormality determination step, that abnormality has occurred in the outdoor machine or the indoor machine, operation information of the first outdoor machine is displayed in the first operation information display region, and operation information of any of the plurality of first indoor machines is displayed in the second operation information display region, and in a case where it is determined, in the abnormality determination step, that abnormality has occurred in the outdoor machine, if the outdoor machine in which the abnormality has occurred is the first outdoor machine, the operation information of the first outdoor machine indicating the abnormality is displayed in the first operation information display region, and if the outdoor machine in which the abnormality has occurred is the second outdoor machine, the operation information of the second outdoor machine indicating the abnormality is displayed in the first operation information display region, and operation information of any of the plurality of second indoor machines is displayed in the second operation information display region.

13. The display method according to claim 10, wherein, the outdoor machine and the indoor machine include at least a first group which includes a first outdoor machine and a plurality of first indoor machines connected to the first outdoor machine, and a second group which includes a second outdoor machine and a plurality of second indoor machines connected to the second outdoor machine, in a case where it is not determined, in the abnormality determination step, that abnormality has occurred in the outdoor machine or the indoor machine, operation information of the first outdoor machine is displayed in the first operation information display region, and operation information of any of the plurality of first indoor machines is displayed in the second operation information display region, and in a case where it is determined, in the abnormality determination step, that abnormality has occurred in the indoor machine, if the indoor machine in which the abnormality has occurred is the first indoor machine, the operation information of the first indoor machine indicating the abnormality is displayed in the second operation information display region, and if the indoor machine in which the abnormality has occurred is the second indoor machine, the operation information of the second indoor machine indicating the abnormality is displayed in the second operation information display region, and operation information of the second outdoor machine is displayed in the first operation information display region.

14. A display program which is operated in an information terminal including an input device, a display device, a processing device, and a storage device, and is executed in the processing device in order to cause the display device to display operation information of an air conditioner in which an outdoor machine including an outdoor heat exchanger and an indoor machine including an indoor heat exchanger are connected to each other by a refrigerant pipe, and a refrigerant is circulated by a compressor, the program causing the processing device to execute:

a determination function of determining whether or not abnormality has occurred in the outdoor machine or the indoor machine when the air conditioner operates, based on information input from the input device;

a display function of displaying the operation information to be input from the input device, controls the display unit to display a plurality of operation information display regions in a vertical direction or the transverse direction, and the operation information display region displays time information in a transverse direction and displays the operation information corresponding to the time information in a vertical direction in respective time-series graphs; and an abnormality display function of controlling the display unit to display operation information of the outdoor machine or the indoor machine in which the abnormality has occurred, in a time-series graph in one of the operation information display regions, and to display operation information of an indoor machine or an outdoor machine which is connected to the outdoor machine or the indoor machine in which the abnormality has occurred, by the refrigerant pipe, in a time-series graph in another of the operation information display regions, in a case where it is determined, in the determination function, that abnormality has occurred in the outdoor machine or the indoor machine.

* * * * *